US006315238B1

(12) United States Patent
Kirschner, Jr.

(10) Patent No.: US 6,315,238 B1
(45) Date of Patent: Nov. 13, 2001

(54) THRUSTING APPARATUS

(75) Inventor: Thomas J. Kirschner, Jr., Northeast, MD (US)

(73) Assignee: Cordant Technologies Inc., Salt Lake City, UT (US)

( * ) Notice: Subject to any disclaimer, the term of this patent is extended or adjusted under 35 U.S.C. 154(b) by 0 days.

(21) Appl. No.: 07/212,468

(22) Filed: Jun. 28, 1988

(51) Int. Cl.[7] ..... F41G 7/00; F42B 10/00; F42B 15/01; G06F 19/00

(52) U.S. Cl. ..... 244/3.22

(58) Field of Search ..... 244/3.22; 239/265.19, 239/265.25

(56) References Cited

U.S. PATENT DOCUMENTS 4,413,795 * 11/1983 Ryan ..... 244/3.22

* cited by examiner

*Primary Examiner*—Charles T. Jordan
*Assistant Examiner*—Christian M. Bost
(74) *Attorney, Agent, or Firm*—Sullivan Law Group

(57) ABSTRACT

Thrusting apparatus for guiding missiles or other projectiles. A plurality of side-by-side solid propellant gas generators are provided to discharge axially into a plate which has a rim and a plurality of nozzles which extend radially in the plate and discharge radially from the rim so as to produce thrust normal to the projectile axis on a single plane. The nozzle structure is of laminant construction whereby the materials may be varied from materials which are resistant to high temperature gas flow and erosion in the area of the nozzles and gas flow passageways to medium temperature resistance materials which require good structural properties at other locations for high quality at minimum cost. The configuration also allows minimum volume and length.

20 Claims, 4 Drawing Sheets

THRUSTING APPARATUS

The present invention relates to thrusting apparatus such as may be used for guiding projectiles such as gun launched projectiles and hypervelocity missiles.

Missile or projectile control may be achieved by producing thrust at right angles to the missile or projectile axis in a single radial plane thereof. If the pulses are provided by separate axial flow motors which are positioned with their axes normal to the projectile axis, space limitations may undesirably limit the number of pulses in the same plane.

The firing of a number of gas generating devices into common plenum requires a specific orientation of the plenum opening to achieve the desired results. In other words, the firing must occur at a specific time when the plenum opening is at a specific point during spinning of the projectile Fluidic devices which direct gas flow into laminated structures require a large number of electronic components and stages and may allow gas leaks in undesired directions. A large amount of space as well as weight, which are at a premium on missiles and other projectiles, may as a result be undesirably required.

It is accordingly an object of the present invention to provide a thrusting apparatus wherein the pulses are all in the same radial plane or in a pair of closely spaced radial planes.

It is another object of the present invention to provide such a thrusting apparatus which occupies a minimum amount of space and has a minimum weight.

It is a further object of the present invention to provide such a thrusting apparatus which is rugged yet reliable.

The above and other objects as well as features and advantages of this invention will be apparent in the following detailed description of the preferred embodiments thereof which is to be read in connection with the accompanying drawings.

DETAILED DESCRIPTION OF THE PREFERRED EMBODIMENTS

Figure 1:
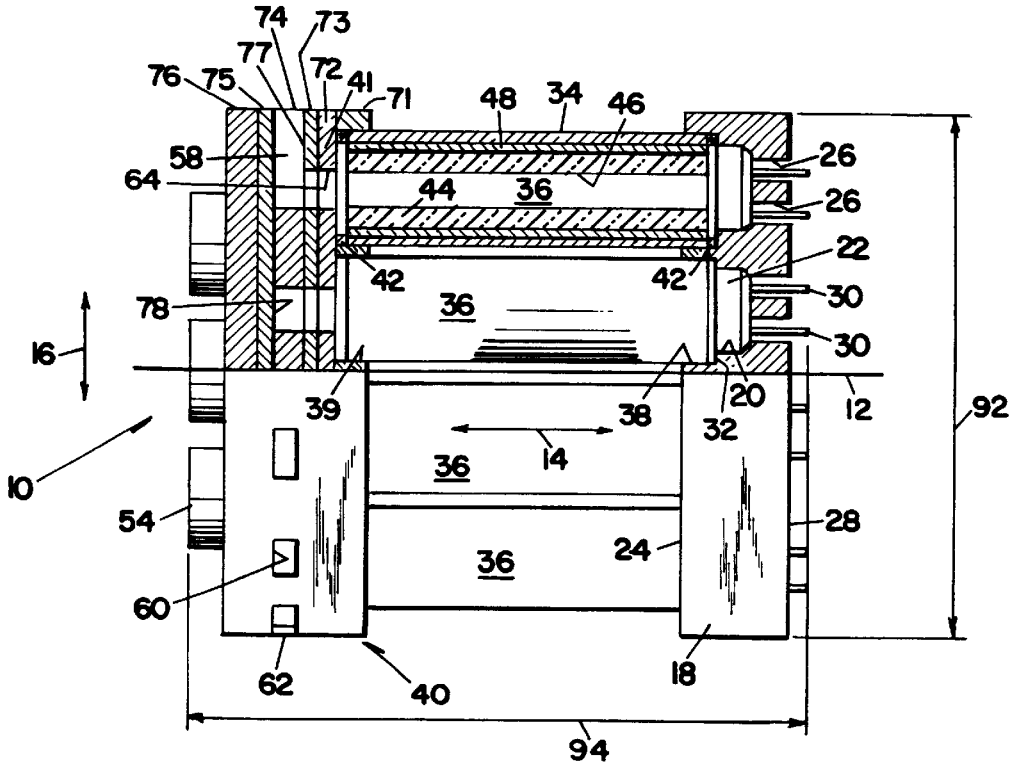
FIG. 1 is a side view, partially in section, of apparatus which embodies the present invention.

Referring to FIG. 1, there is shown generally at 10 apparatus for producing thrust for guiding a missile or other projectile. The apparatus 10 is generally cylindrical in configuration and has an axis, illustrated at 12, about which apparatus 10 is generally symmetrical.

Apparatus 10 is mountable on the aft portion of and coaxial with the projectile being guided. However, thrusting apparatus according to the present invention may be mounted on the forward portion of the projectile or anywhere between the forward and aft portion. The mounting is usually co-axial but need not be so. But axis 12 will usually be substantially parallel to the longitudinal axis of the projectile being guided. As used in this specification and the claims, the terms "axial" or "axially" are meant to refer to a direction, illustrated at 14, along or parallel to the axis 12, and the terms "radial" or "radially" are meant to refer to direction, illustrated at 16, perpendicular to the axis 12.

Shown at 18 is a generally cylindrical plate which has a plurality of generally circular openings 20 which extend axially part of the way through the plate 18 to receive suitable solid propellant igniters illustrated at 22 therein. The openings 20 are formed in the rear or aft side 24 of the plate 18. The openings 20 include a radially outer row and a radially inner row with the openings 20 in each row spaced circumferentially around the plate 18. A pair of apertures 26 extend into the plate 18 from the forward side 28 thereof, i.e., the side mountable to the aft portion of a projectile, and into each opening 20. A pair of igniter pins 30 extend through each pair respectively of apertures 26 for suitably connecting the respective igniter 22 to a source of electrical energy for energizing thereof. The particular type of igniter 22 may be selected from those conventionally known using principles commonly known to those of ordinary skill in the art to which this invention pertains.

The aft end of each opening 20 is enlarged to a larger bore 38, thereby defining a shoulder 32, for receiving an end portion of an elongate cylindrical case 34 of a gas generator, generally illustrated at 36, therein. Thus, a plurality of gas generators 36 are positioned in a side-by-side relationship and extend axially rearwardly from the igniter plate shoulder 32, and the aft end portion of each case 34 is received in a corresponding bore 39 which extends part way through a generally circular nozzle assembly, generally indicated at 40, to a shoulder 41 therein.

A suitable seal 42 is positioned respectively between each end of the respective case 34 and the respective shoulder 32 and 41 to seal against the escape of generated gases from the respective gas generator 36. The seals 42 are composed of copper but may be composed of other suitable material such as asbestos or an elastomeric material.

Inwardly of each case 34 is disposed a solid propellant charge illustrated at 44. In order to provide precise timing for accurate missile guidance, the solid propellant charge 44 is composed and configured to provide a high burn rate, that is, a total burn time on the order of less than 20 milliseconds. In order to achieve such a high burn rate, a suitable high burn rate propellant, which can be selected from those known to those of ordinary skill in the art to which this invention pertains, such as one containing polybutadiene/ammonium perchlorate, for example, a propellant composed of by weight 5 percent aluminum, 77 percent ammonium perchlorate, 2 percent iron oxide combustion catalyst, and 16 percent polybutadiene binder, is provided, and the solid propellant is perforated, as illustrated at 46, over its length in a circular perforate or other suitable configuration for rapid burning to provide the desired burn time. A suitable liner 48 is provided between the solid propellant 44 and the case 34. Because of the short duration of the burn time, it is not usually considered necessary to provide insulation material between the case 34 and propellant 44.

However, if necessary, a suitable insulation may be thus provided.

In order that the gas produced by the plurality of axially extending solid propellant gas generators 36 may be directed to produce thrust at right angles to the axis 12 (radially of the apparatus 10) in a single plane in accordance with the present invention, there are provided in the nozzle assembly 40 a plurality of nozzles, illustrated at 58, which extend radially outwardly to outlets 60 which are spaced apart circumferentially along the rim 62 thereof. By "rim" is meant the circumferentially extending radially outer surface of a nozzle assembly. A passageway 64 extends axially through the nozzle assembly 40 between each respective bore 39 and the respective nozzle 58 to provide flow communication of generated gases from the respective gas generator 36 to the respective nozzle 58.

Figure 2:
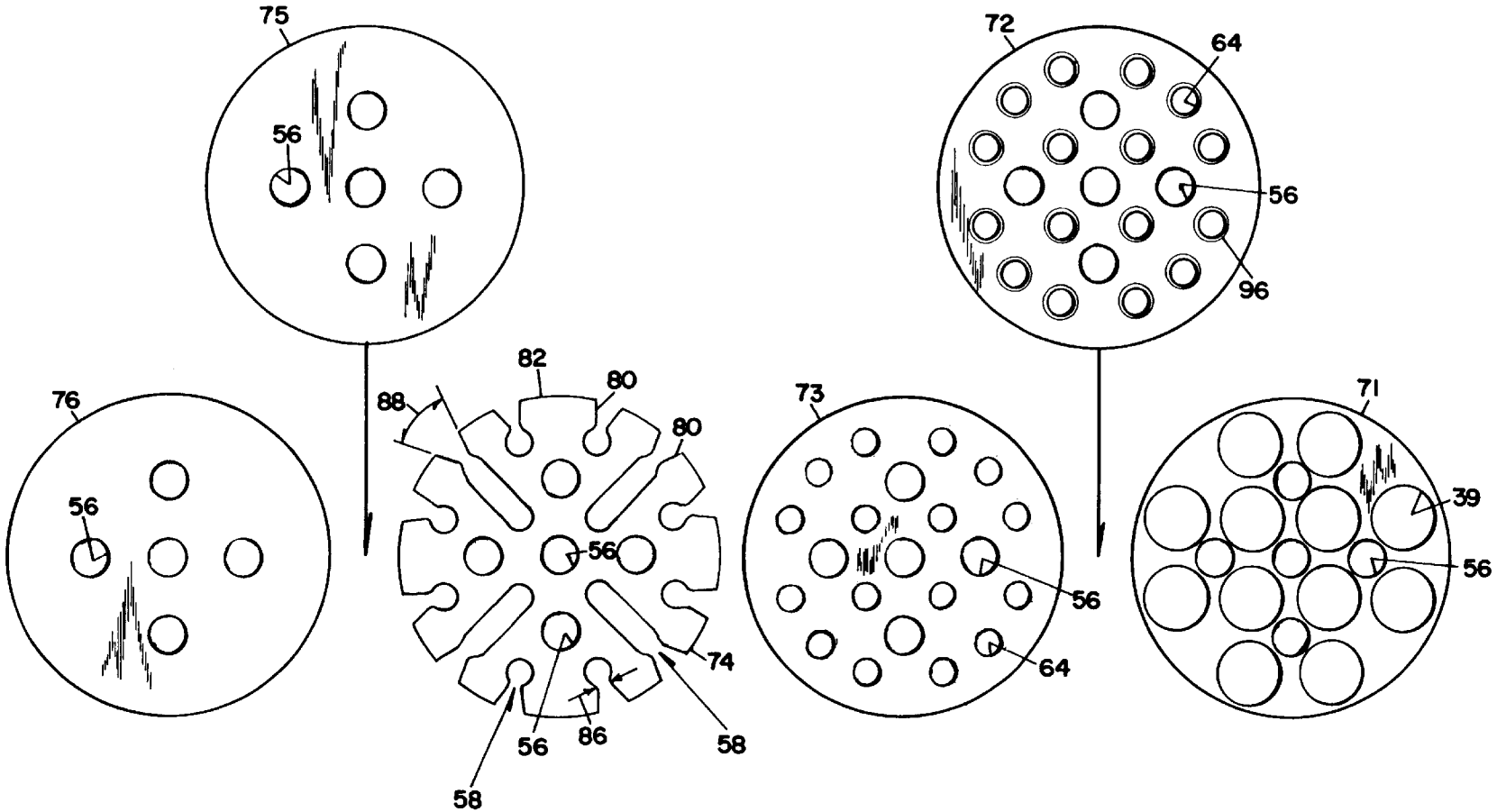
FIG. 2 is a plan view of each of a series of members of the laminated nozzle assembly of the apparatus of FIG. 1.

Portions of the nozzle assembly 40 require good structural properties such as high strength while requiring medium resistance to temperatures, i.e., ability to withstand temperatures up to about 1000° F. Other portions of the nozzle assembly 40 such as the portions which contain the nozzle surfaces require high density and high temperature (temperatures above about 3500° F., for example, temperatures in the range of 6000° F.) and erosion resistance while requiring minimal strength. Referring to FIG. 2, in order to achieve the most desirable properties for each of the portions of the nozzle assembly 40 and provide reduced cost by limiting the use of the more expensive high temperature resistance materials and in order to simplify the nozzle construction in accordance with a preferred embodiment of the present invention, the nozzle assembly 40 is laminated whereby it is composed of a plurality of plates comprising in order beginning with the plate in which the gas generator cases 34 are inserted, a first plate 71 referred to herein as an "inlet plate", a second plate 72 referred to herein as an "outer orifice plate", a third plate 73 referred to herein as an "inner orifice plate", a fourth plate 74 referred to herein as a "nozzle plate", a fifth plate 75 referred to herein as an "inner end plate", and a sixth plate 76 referred to herein as an "outer end plate".

The apparatus 10 including the laminated plates 71 to 76 is sealingly held together by means such as, for example, five cap screws 54 which pass through corresponding apertures 56 in the plates 71 to 76 and engage screw threads (not shown) in the igniter plate 18, or by bonding, diffusion bonding, welding, or any other suitable means. Alternatively, the attachment means may be bolts which pass entirely through the igniter plate 18 and are engaged by nuts.

The inlet plate 71 contains apertures providing the bores 39 in the nozzle assembly 40 in FIG. 1 for receiving the gas generator cases 34.

The outer and inner orifice plates 72 and 73 respectively are substantially identical in shape and contain orifices which provide the passageways 64 in the nozzle assembly 40 in FIG. 1 for routing generated gases from the respective gas generators 36 to the respective nozzles 58. As shown in FIG. 1, the aft surface 77 of the inner orifice plate 73 partially defines the nozzles 58.

The inner and outer end plates 75 and 76 respectively are substantially identical in shape and are provided for structural support and containment of the nozzles 58. As shown in FIG. 1, the forward surface 78 of the inner end plate 75 partially defines the nozzles 58.

The nozzle plate 74 is sandwiched between the inner orifice and end plates 73 and 75 respectively and includes nozzle shaped cut-outs 80 in the circumferential surface 82 which together with the surfaces 77 and 78 respectively of the inner orifice and end plates 73 and 75 respectively define the nozzles 58. The cut-outs or openings 80 for the radially outer gas generators 36 extend radially inwardly to provide flow communication with the respective passageways 64 therefor. The openings 80 for the radially inner gas generators 36 extend a greater distance radially inwardly to provide flow communication with the respective passageways 64 therefor, as shown by every third nozzle cut-out in FIG. 2.

Typically, a nozzle 58 may have a throat diameter, illustrated at 86, of perhaps 0.05 inch and an outlet angle illustrated at 88 of perhaps 60°. However, the particular throat diameter 86 and angle 88 for a particular application may vary and may be selected using principles commonly known to those of ordinary skill in the art to which this invention pertains in order to regulate the operating pressure of the gas generant charges.

Figure 3:
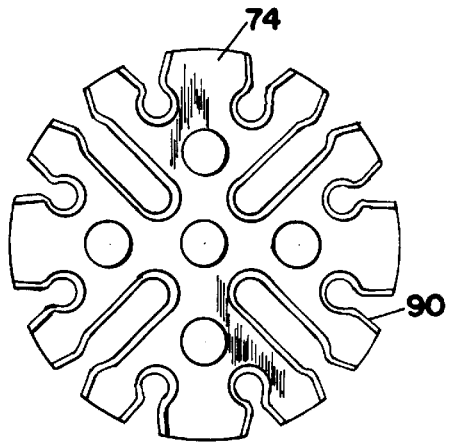
FIG. 3 is an alternative plan view of the nozzle plate of FIG. 2.

In order to provide resistance to high temperature gas flow and erosion in the nozzles in accordance with a preferred embodiment of the present invention, the nozzle plate 74 is composed of a suitable refractory material such as TZM (tungsten zirconium molybdenum alloy). Where the term "refractory material" is used in this specification and the claims, it is meant to include a high temperature resistant ceramic material such as graphite and a high temperature resistant refractory metal such as TZM. By "high temperature resistant" or "high temperature resistance" is meant, for the purpose of this specification and the claims, ability to withstand temperatures over about 3500° F. In order to provide reduced cost, the nozzle plate 74 may be composed, as shown in FIG. 3, of a suitable less expensive medium temperature resistant material such as carbon or beryllium with TZM or other refractory material inserts illustrated at 90 for lining the nozzle cut-outs 80. By "medium temperature resistant" or "medium temperature resistance" is meant, for the purpose of this specification and the claims, ability to withstand temperatures up to about 1000° F. The third and fifth plates 73 and 75 are preferably composed of TZM or other suitable refractory material to also provide resistance to high temperature gas flow and erosion resistance in the nozzles 58 as well as apertures 64 while also desirably providing low density low thermal conductivity so as to minimize temperature increase in surrounding plates and structures.

The igniter plate 18, inlet plate 71, outer orifice plate 72, and outer end plate 76 as well as the gas generator cases 34 are preferably composed of a material such as titanium or a beryllium alloy which provides medium temperature resistance as well as high structural strength at a reduced cost. In order to prevent some local erosion which would not usually be expected to affect performance, the portions of the outer orifice plate 72 surrounding the apertures 64 may be lined with inserts 96 of TZM or other suitable refractory material to protect against the high temperature gas flow therethrough.

The present invention is not limited to the number of laminated plates shown and described herein, and the number of plates may be varied. For example, the first and second plates 71 and 72 respectively may be combined as a single plate. However, separate first and second plates 71 and 72 respectively are preferably provided to simplify construction. Likewise, separate third, fourth, and fifth plates 73, 74, and 75 respectively are provided to simplify construction. Likewise, the present invention is not limited to the plates being composed of the specific materials described herein. For example, although it is preferred that the plate material for each plate be selected for best performance and cost as previously discussed, all of the plates may if desired be composed of the more expensive TZM or other refractory material.

Thrusting apparatus 10 which embodies the present invention may be compactly sized with minimum volume and length. For example, the apparatus 10 may have an overall diameter, illustrated at 92, of perhaps 1.574 inch and have an overall length, illustrated at 94, of perhaps 1.858 inch. Furthermore, laminated plates are used for the nozzle assembly 40 to not only simplify construction but also to permit the utilization of material with the best characteristics at each location so that high quality may be achieved at a minimum cost. By varying the types of material in each lamination, the apparatus 10 may combine resistance to the high temperatures of hot gases in the nozzles 58 with low density low conductivity material in other locations to thereby reduce heat transfer to adjacent structural materials, and high structural strength materials at locations where it is needed.

The plurality of cases 34 may if desired be built as a single piece, and such a construction is meant to come within the scope of the claims of the present invention. However, it is preferable that the cases be built as individual components, as shown in FIG. 1, in order to maintain reduced weight.

The thickness of the igniter plate 18 may typically be 0.25 inch; that of the inlet plate 71 may be 0.08 inch; that of the outer orifice plate 72 may be 0.05 inch; that of the inner orifice plate 73 may be 0.05 inch; that of the nozzle plate 74 may be 0.05 inch; that of the inner end plate 75 may be 0.05 inch, and that of the outer end plate 76 may be 0.12 inch. The diameter of each case 34 may typically be 0.33 inch, and the diameter of each perforation 46 may typically be 0.11 inch.

Figure 4:
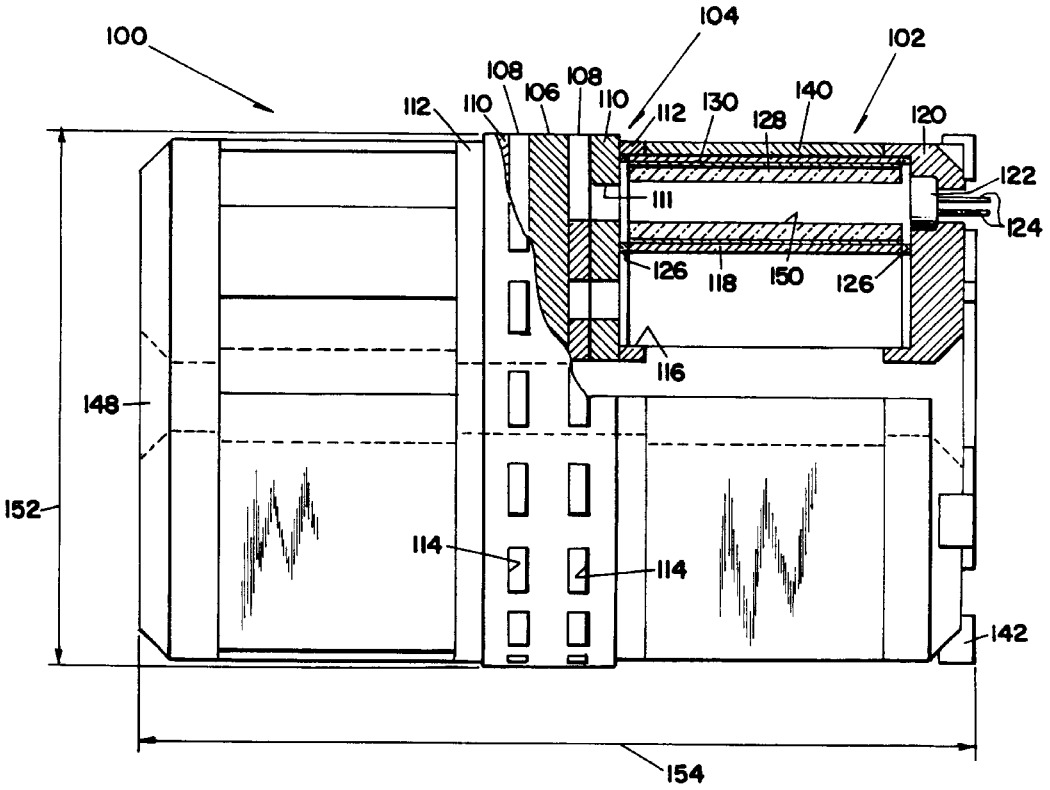
FIG. 4 is a side view, partially in section, of an alternative embodiment of apparatus which embodies the present invention.
Figure 5:
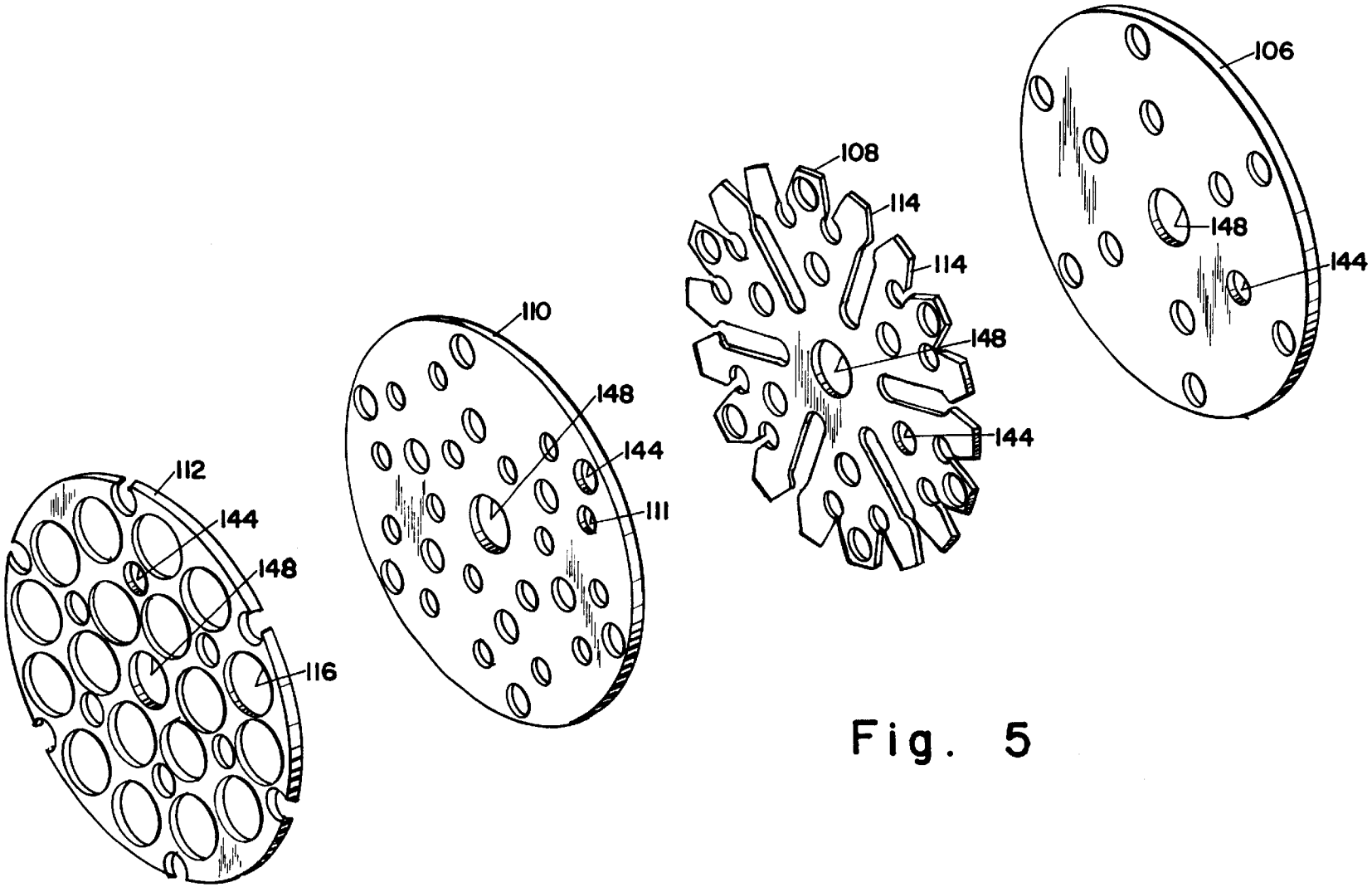
FIG. 5 is an isometric view of each of a series of laminated members which partially compose the laminated nozzle assembly of the apparatus of FIG. 4.

Referring to FIGS. 4 and 5, there is illustrated at 100 an alternative embodiment of apparatus according to the present invention. The apparatus 100 is a double sided thruster configuration wherein two sets of 18 gas generator charges, generally illustrated at 102, similar to the gas generator charges 36 in FIG. 1, are located on opposite sides of a laminated plate nozzle assembly, generally indicated at 104. In this apparatus 100, the thrust is produced in two separate planes which are close together, i.e, separated by plate 106.

The laminated nozzle assembly 104 comprises center plate 106, a nozzle plate 108 on each side thereof which provides the nozzles 114 in the two respective planes, an orifice plate 110 on each side thereof which provides the apertures 111 extending axially thereof for providing flow communication between the gas generator charges 102 and the nozzles 114, and finally inlet plates 112 on each side thereof and having apertures 116 for receiving the gas generator cases 118 at the gas outlet ends thereof. The other ends of the cases 118 are received in an igniter plate 120, similar to igniter plate 18 in FIG. 1, in which is contained a suitable igniter 122 having igniter leads 124 extending therefrom. Each end of the case 118 is sealed by a suitable seal 126, similar to seal 42 of FIG. 1. Contained within each case 118 is a suitable propellant material 128, similar to the solid propellant material 44 in FIG. 1. A suitable liner 130 is positioned between the propellant 128 and the case 118. The apparatus 100 is sealingly attached together by a series of 12 bolts, illustrated at 142, which are received in apertures 144 in the laminated plates. A center passageway 148 for routing of wires to the igniter pins 124 or other parts of the projectile extends axially through apparatus 100. If desired, a center bolt may be provided therein. An overwrap 140 of a graphite/epoxy composite may be provided about the cases 118 for support thereof. A similar overwrap may be provided about the cases 34 of FIG. 1.

FIG. 5 illustrates in isometric view the center plate 106, and also illustrates the nozzle plate 108, orifice plate 110, and inlet plate 112 on one side of the center plate 106. The center plate 106, which may have a thickness of perhaps 0.15 inch, is preferably composed of TZM or other suitable high temperature resistant refractory material. However, it may be composed of a three-piece laminant wherein the center laminant is composed of a material such as titanium or a beryllium alloy which provides medium temperature resistance and high structural strength at reduced cost, and wherein the outer laminations are composed of TZM or other suitable high temperature resistant refractory material. The nozzle plates 108, which may have a thickness of typically 0.07 inch, are similar to the nozzle plate 74 in FIG. 2 but alternatively may have inserts similar to the inserts 90 in FIG. 3. The orifice plates 110, which may have a thickness of 0.1 inch, are similar to the inner orifice plate 73 in FIG. 2, but each may be composed of an inner and outer orifice plate which are similar to the inner and outer orifice plates 72 and 73 of FIG. 2. The inlet plates 112. each of which may have a thickness of typically 0.1 inch, are similar to the inlet plate 71 in FIG. 2. Each case 118 may have a diameter typically of 0.35 inch, and the perforation 150 therein, which is similar to the perforation 46 in FIG. 1, may have a diameter of typically 0.15 inch. The apparatus 100 may advantageously have a compact volume wherein the overall diameter 152 may typically be about 1.92 inch and the overall length 154 may typically be about 3.07 inch.

Figure 6:
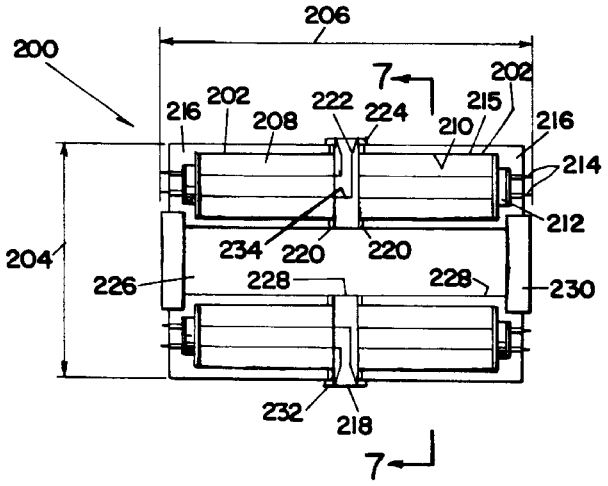
FIG. 6 is a schematic sectional view of yet another embodiment of apparatus which embodies the present invention.
Figure 7:
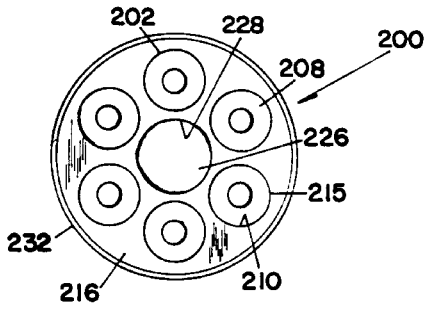
FIG. 7 is a sectional view of the apparatus of FIG. 6 taken along lines 7—7 thereof.

Referring to FIGS. 6 and 7, there is illustrated another embodiment of apparatus according to the present invention. As shown therein, thrusting apparatus, illustrated generally at 200, is constructed such that thrust is produced in a single plane with gas generators disposed on both sides of that plane.

The apparatus 200 is generally cylindrical and may typically have a diameter, illustrated at 204, of about 0.9 inch and a length, illustrated at 206, of about 1.413 inch to occupy a minimum amount of space. The gas generators 202, which include center perforate high burn rate grains 208, which may typically have a length of 0.517 inch and a diameter of 0.25 inch, ignited by igniters 212 including igniter pins 214, and including liners 215, are similar to the gas generators 36, including grains 44, liners 48, igniters 22, and igniter pins 30, of apparatus 10 of FIG. 1. The grains 208 are received in bores 210 of a generally cylindrical housing 216 one of which is disposed on each side of a laminated nozzle assembly 218 and sealingly engages the nozzle assembly 218 by means of seals 220 composed of a suitable material such as copper, asbestos, or an elastomeric material.

Each housing 216 holds six gas generators 202 spaced at about 60 degrees circumferentially thereabout, as illustrated in FIG. 7. The bores 210 of one housing 216 are offset circumferentially from the bores 210 of the other housing by about 30 degrees whereby twelve nozzles 222, similar to nozzles 58 in FIG. 1, are spaced at about 30 degrees circumferentially about the rim 224 of the nozzle assembly 218 with the nozzles 222 alternately supplied by gas from a gas generator in one housing then by gas from a gas generator in the other housing, i.e., if one nozzle is supplied by a gas generator in one housing, then the adjacent nozzles will be supplied by gas generators in the other housing.

The apparatus 200 is sealingly held together by axially extending center bolt 226, which passes through apertures 228 in the laminated nozzle assembly 218 and housings 216, and nut 230 or by other suitable means as discussed with respect to apparatus 10 of FIG. 1. A protrusion 232, which may be integral with a lamination of the nozzle assembly 218 or suitably secured thereto, extends axially over the rim 224 and overlaps the seals 220 to lock them in position. The protrusion 232 may be a single circumferentially extending ring or it may comprise a plurality of intermittent members.

The nozzle assembly 218, which may include a plurality of laminated plates constructed to provide the nozzles 222 and flow passages 234 thereto from gas generators 202 alternately on opposite sides thereof, is similar to the nozzle assembly 40 of the apparatus 10 of FIG. 1 and can be constructed using the teachings provided hereinbefore and principles of common knowledge to those of ordinary skill in the art to which this invention pertains.

Referring again to FIG. 1, operation of the thrusting apparatus 10 begins with a signal through igniter pins 30 to the igniter 22 for the particular gas generator 36 to be fired. The particular gas generator to be fired depends upon the desired direction of thrust at the moment of firing. The electric current through the igniter pins 30 energizes the respective igniter 22 which in turn ignites the solid propellant material 44 which burns at a high burn rate, i.e., on the order of less than 20 milliseconds, to produce gas which flows axially therefrom through passageway 64 to the respective nozzle 58 after which the gas changes direction and flows radially outwardly through the nozzle thus providing thrust. The nozzles are located in accordance with the present invention in a single plane, as shown in FIGS. 1 and 6, or in a minimum number of planes, as shown in FIG. 4, in order to provide simplification of control. Yet in accordance with the present invention, the overall length and volume of the apparatus may be minimized while allowing selectivity in use of materials in the nozzle structure for both high quality and reduced cost.

It is to be understood that the invention is by no means limited to the specific embodiments which have been illustrated and described herein, and that various modifications thereof may indeed be made which come within the scope of the present invention as defined by the appended claims.

What is claimed is:

1. An apparatus comprising a plurality of elongate solid propellant gas generating means extending axially of the apparatus, a plate means having a rim, a plurality of nozzle means in said plate means and having a plurality of corresponding outlet means spaced along said rim for releasing generated gases radially outwardly of the apparatus from said rim, and means for routing generated gases from each of said gas generating means to a corresponding one of said nozzle means.

2. An apparatus according to claim 1 wherein said plate means comprises a plurality of laminated plates.

3. An apparatus according to claim 1 wherein said plate means comprises a plurality of laminated plates including at least one plate having aperture means for receiving end portions of said gas generating means, at least one plate having a plurality of nozzle means, at least one plate having aperture means for routing generated gases from said gas generating means to said respective nozzle means, and at least one end plate.

4. An apparatus according to claim 1 wherein said plate means comprises a plurality of laminated plates including a first plate composed of a medium temperature resistance material having aperture means for receiving end portions of said gas generating means, a second plate composed of a medium temperature resistance material having aperture means for routing generated gases from said gas generating means to said respective nozzle means, a third plate composed of a refractory material having aperture means for routing generated gases from said gas generating means to said respective nozzle means and which third plate defines, relative to said gas generating means, the axially inner surface of each of said nozzle means, a fourth plate composed of a refractory material and which includes a plurality of radially extending cut-out means partially defining said nozzle means, a fifth plate composed of a refractory material which defines, relative to said gas generating means, the axially outer surface of each of said nozzle means, and a sixth plate composed of a medium temperature resistance material for providing structural support to the plate means.

5. An apparatus according to claim 1 wherein said plate means comprises a plurality of laminated plates including a first plate composed of a medium temperature resistance material having aperture means for receiving end portions of said gas generating means, a second plate composed of a medium temperature resistance material having aperture means for routing generated gases from said gas generating means to said respective nozzle means, a third plate composed of a refractory material having aperture means for routing generated gases from said gas generating means to said respective nozzle means and which third plate defines, relative to said gas generating means, the axially inner surface of each of said nozzle means, a fourth plate composed of a material selected from the group consisting of carbon and beryllium and which includes a plurality of radially extending cut-out means partially defining said nozzle means, an insert composed of a refractory material in each of said cut-out means to provide a nozzle means surface, a fifth plate composed of a refractory material which defines, relative to said gas generating means, the axially outer surface of each of said nozzle means, and a sixth plate composed of a medium temperature resistance material for providing structural support to the plate means.

6. An apparatus according to claim 1 wherein said plate means comprises a plurality of laminated plates including a first plate having aperture means for receiving end portions of said gas generating means, a second plate having aperture means for routing generated gases from said gas generating means to said respective nozzle means, a third plate for routing generated gases from said gas generating means to said respective nozzle means and which defines, relative to said gas generating means, the axially inner surface of each of said nozzle means, a fourth plate which includes a plurality of radially extending cut-out means partially defining said nozzle means, a fifth plate defining, relative to said gas generating means, the axially outer surface of each of said nozzle means, and a sixth plate for providing structural support to said plate means, said first, second, and sixth plates composed of a material selected from the group consisting of titanium and a beryllium alloy, and said third, fourth, and fifth plates composed of a refractory material.

7. An apparatus according to claim 6 wherein at least one of said third, fourth, and fifth plates is composed of tungsten zirconium molybdenum alloy.

8. An apparatus according to claim 1 wherein the solid propellant is composed and configured to provide a total burn time of less than 20 milliseconds.

9. An apparatus according to claim 1 comprises a first and a second plurality of said nozzle means in said plate means, a first plurality of said gas generating means on a first side axially of said plate means for supplying generated gas to said first plurality of said nozzle means, and a second plurality of said gas generating means on a second side axially of said plate means for supplying generated gas to said second plurality of nozzle means.

10. An apparatus according to claim 1 comprising a first plurality of said gas generating means on a first side axially of said plate means and further comprises a second plurality of said gas generating means on a second side axially of said plate means for supplying generated gas to said plurality of nozzle means alternately with said first plurality of said gas generating means.

11. A guiding apparatus for a missile comprising a plurality of elongate side by side solid propellant gas generating means extending axially of the apparatus, a plate means coaxial with the guiding apparatus and having a circumferentially extending rim, means defining a plurality of nozzles in said plate means each of which extends generally radially of the apparatus to and has an outlet at said rim for releasing generated gases radially outwardly of the apparatus from said rim to provide thrust, the nozzle means outlets being circumferentially spaced about the rim, and means for routing generated gases from each of said gas generating means to a corresponding one of said nozzle means.

12. An apparatus according to claim 11 wherein said plate means comprises a plurality of laminated plates.

13. An apparatus according to claim 11 wherein said plate means comprises a plurality of laminated plates including at least one plate having aperture means for receiving end portions of said gas generating means, at least one plate having a plurality of nozzle means, at least one plate having aperture means for routing generated gases from said gas generating means to said respective nozzle means, and at least one end plate.

14. An apparatus according to claim 11 wherein said plate means comprises a plurality of laminated plates including a first plate composed of a medium temperature resistance material having aperture means for receiving end portions of said gas generating means, a second plate composed of a medium temperature resistance material having aperture means for routing generated gases from said gas generating means to said respective nozzle means, a third plate composed of a refractory material having aperture means for routing generated gases from said gas generating means to said respective nozzle means and which third plate defines, relative to said gas generating means, the axially inner surface of each of said nozzle means, a fourth plate composed of a refractory material and which includes a plurality of radially extending cut-out means partially defining said nozzle means, a fifth plate composed of a refractory material which defines, relative to said gas generating means, the axially outer surface of each of said nozzle means, and a sixth plate composed of a medium temperature resistance material for providing structural support to the plate means.

15. An apparatus according to claim 11 wherein said plate means comprises a plurality of laminated plates including a first plate composed of a medium temperature resistance material having aperture means for receiving end portions of said gas generating means, a second plate composed of a medium temperature resistance material having aperture means for routing generated gases from said gas generating means to said respective nozzle means, a third plate composed of a refractory material having aperture means for routing generated gases from said gas generating means to said respective nozzle means and which third plate defines, relative to said gas generating means, the axially inner surface of each of said nozzle means, a fourth plate composed of a material selected from the group consisting of carbon and beryllium and which includes a plurality of radially extending cut-out means partially defining said nozzle means, an insert composed of a refractory material in each of said cut-out means to provide a nozzle means surface, a fifth plate composed of a refractory material which defines, relative to said gas generating means, the axially outer surface of each of said nozzle means, and a sixth plate composed of a medium temperature resistance material for providing structural support to the plate means.

16. A thrusting apparatus comprising a plurality of solid propellant elongate gas generating means extending axially of the apparatus, a plate means composed of a plurality of laminated plates and defining a rim, a plurality of nozzle means in said plate means and having a plurality of corresponding outlet means spaced along said rim for releasing generated gases radially outwardly of the apparatus from said rim, and means for routing generated gases from each of said gas generating means to a corresponding one of said nozzle means.

17. An apparatus according to claim 16 wherein said plurality of laminated plates comprises at least one plate having aperture means for receiving end portions of said gas generating means, at least one plate having a plurality of nozzle means, at least one plate having aperture means for routing generated gases from said gas generating means to said respective nozzle means, and at least one end plate.

18. An apparatus according to claim 16 wherein said plurality of laminated plates comprises a first plate composed of a medium temperature resistance material having aperture means for receiving end portions of said gas generating means, a second plate composed of a medium temperature resistance material having aperture means for routing generated gases from said gas generating means to said respective nozzle means, a third plate composed of a refractory material having aperture means for routing generated gases from said gas generating means to said respective nozzle means and which third plate defines, relative to said gas generating means, the axially inner surface of each of said nozzle means, a fourth plate composed of a refractory material and which includes a plurality of radially extending cut-out means partially defining said nozzle means, a fifth plate composed of a refractory material which defines, relative to said gas generating means, the axially outer surface of each of said nozzle means, and a sixth plate composed of a medium temperature resistance material for providing structural support to the plate means.

19. An apparatus according to claim 16 wherein said plurality of laminated plates comprises a first plate composed of a medium temperature resistance material having aperture means for receiving end portions of said gas generating means, a second plate composed of a medium temperature resistance material having aperture means for routing generated gases from said gas generating means to said respective nozzle means a third plate composed of a refractory material having aperture means for routing generated gases from said gas generating means to said respective nozzle means and which third plate defines, relative to said gas generating means, the axially inner surface of each of said nozzle means, a fourth plate composed of a material selected from the group consisting of carbon and beryllium an which includes a plurality of radially extending cut-out means partially defining said nozzle means, an insert composed of a refractory material in each of said cut-out means to provide a nozzle means surface, a fifth plate composed of a refractory material which defines, relative to said gas generating means, the axially outer surface of each of said nozzle means, and a sixth plate composed of a medium temperature resistance material for providing structural support to the plate means.

20. An apparatus according to claim 16 wherein said plurality of laminated plates comprises a first plate having aperture means for receiving end portions of said gas generating means, a second plate having aperture means for routing generated gases from said gas generating means to said respective nozzle means, a third plate for routing generated gases from said gas generating means to said respective nozzle means and which defines, relative to said gas generating means, the axially inner surface of each of said nozzle means, a fourth plate which includes a plurality of radially extending cut-out means partially defining said nozzle means, a fifth plate defining, relative to said gas generating means, the axially outer surface of each of said nozzle means, and a sixth plate for providing structural support to said plate means, said first, second, and sixth plates composed of a material selected from the group consisting of titanium and a beryllium alloy, and said third, fourth, and fifth plates composed of a refractory material.

* * * * *